US005806013A

United States Patent [19]

Paielli

[11] Patent Number: 5,806,013

[45] Date of Patent: Sep. 8, 1998

[54] CONTROL OF ENGINE FUEL DELIVERY USING AN ARTIFICIAL NEURAL NETWORK IN PARALLEL WITH A FEED-FORWARD CONTROLLER

[75] Inventor: Perry M. Paielli, Brighton, Mich.

[73] Assignee: Echlin, Inc., Branford, Conn.

[21] Appl. No.: 920,808

[22] Filed: Aug. 29, 1997

[51] Int. Cl.[6] ..... F12D 41/00

[52] U.S. Cl. ..... 701/106

[58] Field of Search ..... 701/106; 364/424.01, 364/431.12, 431.65, 424.05, 431.04

[56] References Cited

U.S. PATENT DOCUMENTS 5,084,821 1/1992 Oshuga et al. ..... 364/424.05
5,142,612 8/1992 Skeirik ..... 364/151
5,189,621 2/1993 Onari et al. ..... 364/431.04
5,200,898 4/1993 Yuhara et al. ..... 364/431.05

*Primary Examiner*—Raymond A. Nelli
*Attorney, Agent, or Firm*—Barnes, Kisselle, Raisch, Choate, Whittemore & Hulbert

[57] ABSTRACT

A system for controlling operation of engine fuel injectors that includes a feed-forward control unit responsive to signals from sensors on the engine for supplying a basic electronic control signal for the injectors. A neural network is connected in parallel with the feed-forward control unit for receiving the sensor signals and multiplying the sensor signals by associated weighting factors. The sensor signals multiplied by the weighting factors are combined to produce a network output signal, which in turn is combined with the basic control signal from the feed-forward control unit to control operation of the fuel injectors. The weighting factors in the neural network are modified as a function of inputs from the engine sensors so as to reduce any errors in the sensor output signals as compared with desired values.

25 Claims, 2 Drawing Sheets

CONTROL OF ENGINE FUEL DELIVERY USING AN ARTIFICIAL NEURAL NETWORK IN PARALLEL WITH A FEED-FORWARD CONTROLLER

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

Reference is made to a microfiche appendix that accompanies this application, consisting of one sheet of fiche containing fifty-four frames.

The present invention is directed to engine control systems, and more particularly to a system and method for controlling engine fuel delivery responsive to sensors indicative of engine operating conditions.

BACKGROUND AND OBJECTS OF THE INVENTION

U.S. Pat. No. 5,091,858, assigned to the assignee hereof, discloses an engine fuel delivery control system for an engine having at least one fuel injector responsive to electronic control signals for delivering fuel to the engine cylinders. A plurality of sensors supply electrical sensor signals as various functions of engine operating conditions. An electronic engine control unit includes an electronic memory storing engine control parameters in a variety of look-up tables, a microprocessor-based controller for periodically accessing the memory tables and obtaining required control parameters as a function of sensor signal inputs, and circuitry for supplying control signals to the fuel injectors as a predetermined function of the control parameters obtained from the look-up tables.

Fuel delivery systems of this character are well adapted for use in large production volumes, in which the cost of control system development is spread over a large number of units. However, production variables from engine to engine can be such that the program variables prestored in memory do not provide optimum fuel control. Unit calibration can be slightly in error. Furthermore, low volume applications, such as the automotive performance aftermarket, do not provide sufficient production volume to justify a specialized system development cost. It has heretofore been proposed to provide a table of correction factors, using so-called block-learn techniques, in an attempt to address production variations and errors in calibration. This technique involves creation of a separate table of correction factors, employing the heated exhaust gas oxygen (HEGO) sensor, for access during normal operation to provide correction factors to the injector pulse width signals obtained from the calibrated tables. However, this technique suffers from a number of deficiencies, including overlap ambiguity between the correction values. Furthermore, the original calibration value must be fairly close to the corrected value because the correction factor must be close to unity. The block-learn tables do not handle steep slopes or rapid changes in the basic map, and do not well handle transient conditions, which is a particular problem in conjunction with performance vehicles.

It is therefore a general object of the present invention to provide a system and method for engine control, particularly engine fuel delivery, which are well adapted for use in high-volume production, but are also uniquely well suited for adapting a high-volume control system to use in conjunction with limited markets such as the performance aftermarket, which can be readily implemented in otherwise conventional engine control systems, which are self-learning in operation, which readily accommodate both transient conditions and rapid changes in the basic control map, and which exhibit desired stability under a variety of operating conditions.

SUMMARY OF THE INVENTION

Briefly stated, the present invention contemplates use of a neural network, preferably in parallel with an otherwise conventional feed-forward control unit, for responding to engine sensor signals to provide continuously corrected control signals to the engine operating mechanisms, particularly the fuel injectors. The neural network effectively fine tunes the control strategy of the feed-forward control unit to accommodate variations in system components, calibration or operating conditions. In a presently preferred implementation of the invention for controlling operation of at least one fuel injector on an engine, the engine sensor signals are multiplied within the neural network by associated weighting factors, and are then combined to provide a network output signal. The network weighting factors are modified as a function of the engine sensor signals so as to drive toward zero any error in the sensor signals from desired operation. Specifically, in a preferred embodiment of the invention, at least one of the sensor signals is compared to a preset value, and the weighting factors are modified to drive toward zero any difference between the sensor signal and the preset value. The control signals to the engine fuel injectors are provided as a function of the network output signal, preferably in combination with a basic control signal from the parallel feed-forward control unit.

The neural network preferably is implemented in a digital processor along with the feed-forward control unit, which is to say that the feed-forward control unit and the neural network are implemented together by suitable programming within a single microprocessor-based controller. The neural network thus implements corrections in the main control strategy dictated by the feed-forward controller. The neural network of the present invention, as with neural networks in general, is characterized by back-propagation of errors to tailor the weighting factors in an effort to drive the output error to zero. However, the weighting factors are tailored in accordance with the presently preferred embodiment of the invention in a manner quite different from what is conventional in the art to provide improved performance stability under both steady-state and transient operating conditions. Specifically, in contrast to the prior art, only one weighting factor is tailored during each operating cycle of the controller, and sequential weighting factors are altered in sequential cycles as required to approach zero error. Furthermore, again in contrast to the prior art, the weighting factors are not altered or tailored during each operating cycle in accordance with a preselected learning coefficient, but rather are changed by a fixed unit step (increment or decrement) during each cycle. Thus, only one weighting factor is adjusted during each operating cycle, and that factor is adjusted by only one unit step during that cycle. Where the weighting factors are represented by eight-bit bytes, for example, a weighting factor may be incremented or decremented by one bit (assuming that correction is called for) during the associated operating cycle.

The neural network in the preferred embodiment of the invention is a two-layer network having input weighting factors leading to the input or hidden layer of cells, and hidden weighting factors between the hidden cell layer and the output cell layer. In accordance with another feature of the preferred embodiment of the invention, the hidden weighting factors may be varied during programming by an operator, but otherwise remain constant during operation. It is thus the input weighting factors that are modified during operation, preferably one per cycle and only by one unit step, responsive to back-propagation of error. To provide improved performance during transient operating conditions, it has been found desirable not only to feed current sensor signals to inputs of the neural network, but also stored values for such sensor signals during previous operating cycles. Thus, in the preferred embodiment of the invention, current signals indicative of outputs from a manifold air pressure sensor, a speed sensor and a throttle position sensor are fed to the neural network inputs, along with values for such sensor signals during the previous two operating cycles. A bias input is also fed to the neural network for helping to cancel overall system offset errors. Back-propagation of error to tailor the input weighting factors is determined by the output of a heated exhaust gas oxygen (HEGO) sensor, which senses departure of the fuel/air mixture from a stoichiometric level. Thus, where the oxygen sensor indicates that the fuel/air mixture is too rich or too lean, an appropriate factor is generated that determines if a weighting factor is to be modified, which in turn corrects the output of the feed-forward control unit.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF THE PREFERRED EMBODIMENTS

Figure 1:
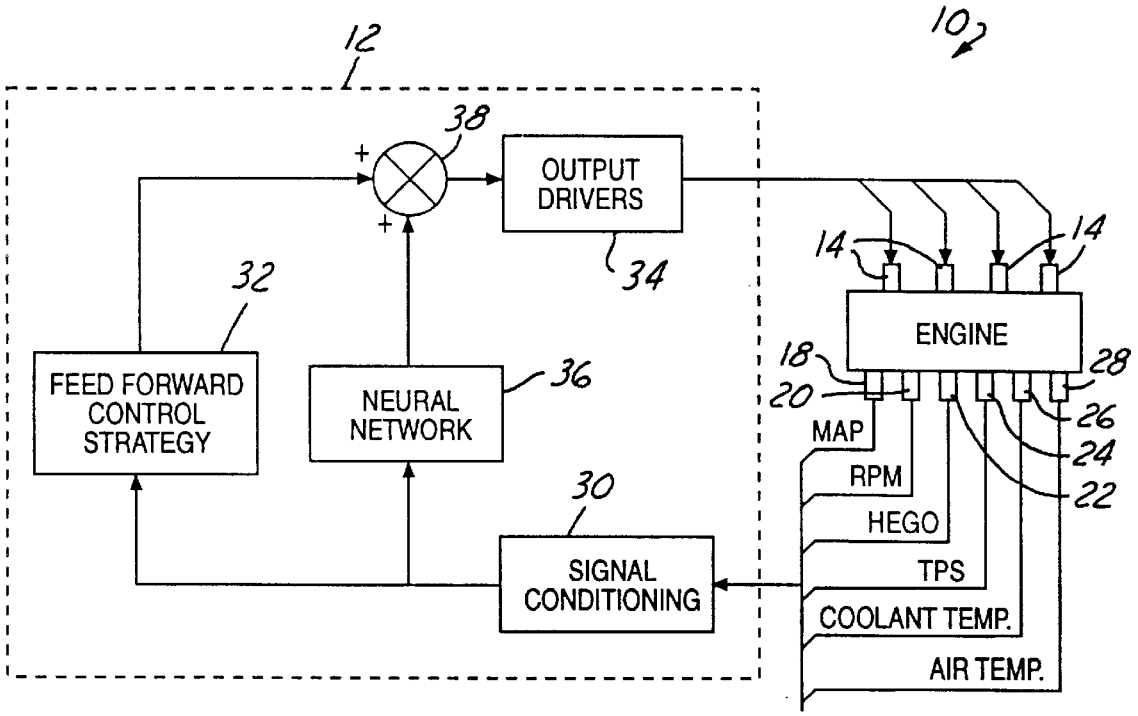
FIG. 1 is a functional block diagram of an engine fuel delivery system in accordance with a presently preferred embodiment of the invention.

FIG. 1 illustrates a fuel delivery system 10 as comprising a controller 12 for delivering control signals to a plurality of fuel injectors 14 on an engine 16. Engine 16 also has associated therewith a manifold air pressure sensor 18 for providing a MAP sensor signal, a speed sensor 20 for providing an RPM sensor signal, a heated exhaust gas oxygen sensor 22 for providing a HEGO signal indicative of oxygen within the engine exhaust gas stream, a throttle position sensor 24 for providing a TPS sensor signal, an engine coolant sensor 26 for providing a signal indicative of engine operating temperature, and a sensor 28 for providing a signal indicative of intake air temperature. The various signals from sensors 18–28 are fed within controller 12 through signal conditioning electronics 30, to a feed-forward control unit 32. Control unit 32 provides an output indicative of desired injector pulse width, which is fed to injectors 14 through associated output drivers 34. To the extent thus far described, system 10 is essentially the same as that disclosed in above-noted U.S. Pat. No. 5,091,858, the disclosure of which is incorporated herein by reference for purposes of background. Control unit 32 preferably comprises a programmed microprocessor-based control unit within which indicia is stored in various look-up tables for relating the input sensor signals to a desired injector pulse width. For example, a basic three-dimensional control map provides a basic injector pulse width as a function of engine speed (RPM) and manifold air pressure (MAP). Additional two-dimensional maps provide correction factors to the basic pulse-width signal as a function of coolant temperature, throttle position, intake air temperature, etc. The output of oxygen sensor 22 may be employed to generate a separate set of correction factors, employing the block-learn technique previously discussed, to accommodate errors in calibration or production variations in components.

In accordance with the present invention, a neural network 36 is connected in parallel with feed-forward control unit 32 for receiving selected sensor output signals from signal conditioning electronics 30, and providing a network output signal to a summer 38 for corrective combination with the output of control unit 32. Neural network 36 is illustrated in greater detail in FIG. 2. Neural network 36 in the preferred implementation of the invention comprises a two-layer fully connected network having an array of hidden cells A1, A2 . . . A8, sometimes referred to as input cells, and a single output cell B1. A bus 40 receives input signals that include the current output $MAP_T$ from sensor 18, the current output $RPM_T$ from speed sensor 20, and the current output $TPS_T$ from throttle position sensor 24. Bus 40 also receives the manifold air pressure signal $MAP_{T-1}$ and the sensor $MAP_{T-2}$ from the previous two operating cycles, which signals are sampled and stored within signal conditioning electronics 30. Likewise, bus 40 receives speed sensor signals $RPM_{T-1}$ and $RPM_{T-2}$ from the previous two operating cycles, and throttle positions sensor signals $TPS_{T-1}$ and $TPS_{T-2}$ from the previous two operating cycles, again stored in signal conditioning electronics 30. Bus 40 also receives a BIAS signal for helping to cancel overall system offset errors.

There are thus a total often input signals to each hidden cell A1 . . . A8. Each of these ten signals to cell A1 is multiplied by an associated weighting factor W10, W11, W12 . . . W19. Thus, input signal $MAP_T$ is multiplied by weighting factor W10, input signal $MAP_{T-1}$ is multiplied by weighting factor W11, input signal $MAP_{T-2}$ is multiplied by weighting factor W12, etc. Likewise, the ten inputs to cell A2 are each multiplied by an associated weighting factor W20–W29, and the ten input signals to cell A8 are each multiplied by an associated weighting factor W80–W89. Each hidden cell A1–A8 provides an associated hidden output that is multiplied by an associated hidden weighting factor W90–W97 to provide a total of eight inputs to output cell B1. The output of cell B1, which forms the output of neural network 36, is fed to summer 38 (FIG. 1).

Neural network 36 also receives as an input the HEGO signal from oxygen sensor 22. This oxygen sensor signal is compared with a SET VALUE, and then fed to network 36 for back-propagation of error to tailor the weighting factors. Conventional oxygen sensors provide an output that varies upwardly and downwardly from a nominal value of 0.45 volts, indicative of a stoichiometric fuel/air ratio of around 14.7 depending upon manufacturer and a number of other factors. This numeral or stoichiometric value is provided as the SET VALUE to the comparator 41 in FIG. 2. Thus, if the output of the oxygen sensor is at 0.45 volts, indicating a stoichiometric fuel/air ratio, the error input to network 36 is zero, and no weighting factor adjustment is implemented. On the other hand, a departure from the stoichiometric output level of the oxygen sensor will result in a corresponding error signal (positive or negative) from comparator 41 to neural network 36, calling for tailoring of the weighting factors.

During initial implementation of the present invention, it was attempted to adjust all weighting factors during each operating cycle by apportioning the total error among the various weighting factors at each network level, and multiplying this apportioned error by a learning coefficient K. However, this was found not to yield desired output stability.

A number of changes were then implemented in conventional neural network techniques to improve stability of the control process. First, only one weighting factor W is modified during each operating cycle. For example, if current operating conditions provide an error input to neural network 36, weighting factor W10 may may be modified upwardly or downwardly during a first cycle. If the error persists during the next operating cycle, weighting factor W11 may be modified upwardly or downwardly, etc. Furthermore, rather than attempt to modify an error factor by a learning coefficient K as is conventional in the art, the weighting factor to be modified during a given operating cycle is modified by a fixed unit step or increment (plus or minus) during the associated operating cycle. It has been found that representation of each weighting factor by an eight-bit word or byte provides desired resolution. In the preferred implementation of the invention, an eight-bit weighting factor is modified during an operating cycle by incrementing (plus or minus) the eight-bit word by one bit. Furthermore, it was found that attempted tailoring of hidden weighting factors W90–W97 did not yield desired stability. Hidden weights W90–W97 were therefore set at fixed values (variable by an operator during programming but fixed during operation), and only input weighting factors W10–W89 were varied, employing the technique described above, during back-propagation of error. It has also been found that use of historical sensor data from the previous two operating cycles, in addition to current sensor data, improves operation responsive to transient changes in operating conditions.

Figure 2:
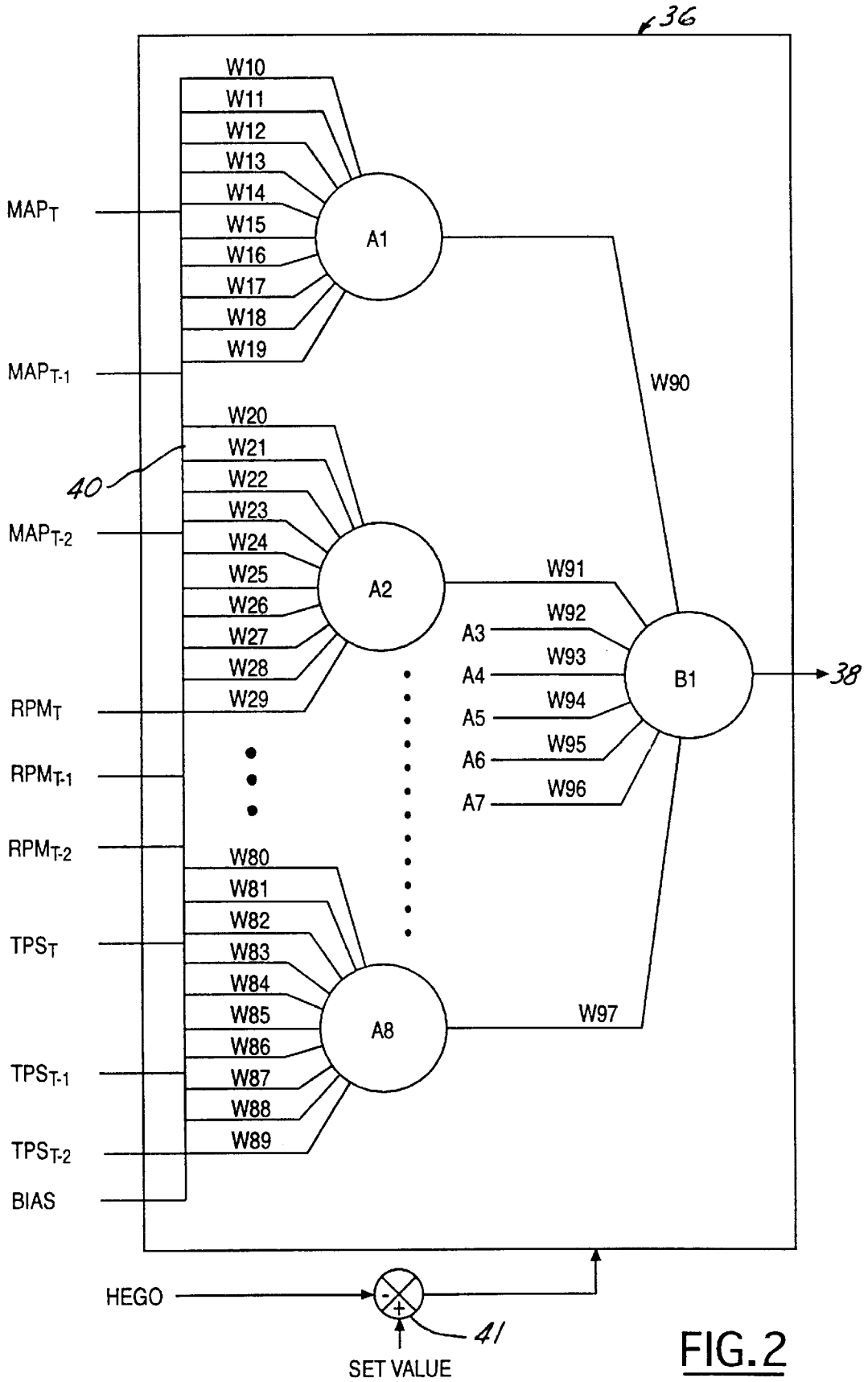
FIG. 2 is a schematic diagram of the neural network illustrated in FIG. 1.

The neurons or cells A1–B1 are identical to each other. Each cell has an associated activation function, which can be tailored during set-up, but are identical for all cells. As noted above, it is currently preferred that network 36 comprise a fully connected network, which is to say that each input to bus 40 is fed to each hidden layer cell A1–A8, and all hidden layer outputs are fed to output cell B1. Asymmetrical networks can also be employed, but are less preferred. It is currently preferred to employ a two-layer network 36, as illustrated in FIG. 2. Such a network arrangement provides the desired amount of control and stability, without unnecessarily increasing complexity and expense. It is preferred to employ the HEGO sensor for sensing correct engine operation, and for generation of weighting factor corrections. However, an engine knock sensor could also or alternatively be employed, or speed sensor 20 for sensing variations in engine speed caused by missfire.

The arrangement of the present invention herein disclosed has been found to yield satisfactory results in an automobile operating on a prescribed urban road course. The control system and method of the invention were demonstrated to be stable and effective over a significant range of operating conditions, and to reduce the distribution of fuel/air ratios during operation. In this working embodiment of the invention, feed-forward control unit 32 and neural network 36 are embodied in a single 68HC11 microprocessor-based controller. This controller had an operating cycle of 78 msec. However, this cycle time is not in any way critical or related to engine speed. The physical structure of neural network 36 may be the same for all engines, while self-learning through back-propagation of error will automatically tailor each network to its associated engine system. The microfiche appendix that accompanies this application illustrates the source code employed in this working embodiment of the invention. A net list was first compiled employing a conventional schematic capture program. The source code of appendix frames 3 to 20 transforms this net list into a usable data structure. The source code of frames 21 to 26 generates the activation function and other characteristics of each neuron A1–B1 and stores this data in look-up tables, while the code of frames 27 to 42 is used to evaluate system performance. The source code of frames 43 to 54 performs the functions of network 36 in FIG. 2, including feed forward of signal data, back-propagation of error and weighting factor update.

I claim:

1. A system for controlling operation of an engine that has at least one mechanism responsive to electronic control signals for affecting engine operation and at least one sensor for supplying electrical sensor signals as a function of engine operating conditions, said system comprising:

a feed-forward control unit including means responsive to said sensor signals for supplying a basic electronic control signal for said mechanism, a neural network connected in parallel with said feed-forward control unit, said neural network including means for receiving said sensor signals, means for multiplying said sensor signals by weighting factors, means for combining said sensor signals multiplied by said weighting factors to provide a network output signal, means for comparing one of said sensor signals to a preset value, and means for modifying said weighting factors as a function of said sensor signals so as to drive toward zero any error between said one sensor signal and said preset value, and means for providing said control signals to said mechanism as a combined function of said basic control signal and said network output signal.

2. The system set forth in claim 1 wherein said neural network is comprised of digital processing means for operating in cycles at periodic intervals.

3. The system set forth in claim 2 wherein said means for modifying said weighting factors comprises means for modifying a differing one of said weighting factors at successive ones of said periodic intervals.

4. The system set forth in claim 3 wherein said means for modifying said weighting factors comprises means for modifying one factor by a preselected amount at each said interval.

5. The system set forth in claim 4 wherein said weighting factors are digital numbers, and are modified by no more than one bit at each said interval.

6. The system set forth in claim 3 wherein said neural network comprises multiple layers having both input weighting factors and factors between said layers, and wherein said means for modifying said weighting factors comprises means for modifying only said input weighting factors responsive to said sensor signals.

7. The system set forth in claim 2 wherein said neural network also includes means for receiving said sensor signals from previous periodic intervals, means for multiplying said sensor signals from previous intervals by associated weighting factors, and means for combining said sensor signals from previous intervals multiplied by said associated weighting factors with current sensor signals multiplied by associated weighting factors to provide said network output signal.

8. The system set forth in claim 1 for controlling engine fuel delivery wherein said sensor signals include signals indicative of engine manifold air pressure, engine rpm and engine exhaust gas oxygen content.

9. The system set forth in claim 8 wherein said sensor signals further includes engine throttle position.

10. The system set forth in claim 8 wherein said one sensor signal comprises said signal indicative of exhaust gas oxygen content.

11. The system set forth in claim 1 wherein said neural network comprises a two-layer network.

12. The system set forth in claim 11 wherein said neural network comprises a fully connected network.

13. The system set forth in claim 1 wherein said feed-forward control unit includes an electronic memory storing engine control parameters in at least one look-up table, and means for periodically addressing said memory as a function of said sensor signals to provide said basic control signal.

14. A method of controlling fuel delivery to an engine that has at least one fuel injector responsive to electronic control signals for delivering fuel to the engine and at least one sensor for supplying sensor signals as a function of engine operation, said method comprising the steps of:

(a) directing said sensor signals to a neural network within which said signals are multiplied by associated weighting factors and combined to provide a network output signal, (b) providing said control signal to said fuel injector as a function of said network output signal, (c) detecting an error in operation at the engine as a function of said sensor signals, (d) altering one of said weighting factors in a way to reduce said error, and (e) repeating said steps (a) through (d) at periodic intervals while altering a different weighting factor in said step (d) at each said interval.

15. The method set forth in claim 14 wherein said step (d) is carried out by altering said one weighting factor by a preselected fixed unit step.

16. The method set forth in claim 15 wherein said neural network comprises multiple neural layers with input weighting factors and weighting factors between layers, and wherein said step (d) comprises the step of altering said input weighting factors while said weighting factors between layers remain constant.

17. The method set forth in claim 16 wherein said sensor signals directed to said neural network in said step (a) include sensor signals from previous cycles of operation.

18. The method set forth in claim 17 wherein said sensor signals include manifold air pressure, engine speed and exhaust gas oxygen content.

19. The method set forth in claim 18 wherein said sensor signals further includes throttle position.

20. A method of controlling fuel delivery to an engine that has at least one fuel injector responsive to electronic control signals for delivering fuel to the engine and a plurality of sensors for supplying sensor signals as a function of differing parameters of engine operation, said method comprising the steps of:

(a) providing a digital controller that operates in cycles at periodic intervals, (b) directing said sensor signals within said controller to a neural network within which said sensor signals are multiplied by associated weighting factors and combined to provide a network to output signal, (c) providing said control signal to said fuel injector as a function of said network output signal, (d) detecting an error in operation at the engine as a function of said sensor signals, and (e) altering one of said weighting factors during each cycle of operation of said controller in a direction to reduce said error.

21. A method of controlling fuel delivery to an engine that has at least one fuel injector responsive to electronic control signals for delivering fuel to the engine and a plurality of sensors for supplying sensor signals as a function of differing parameters of engine operation, said method comprising the steps of:

(a) providing a digital controller that operates in cycles at periodic intervals, (b) directing said sensor signals within said controller to a neural network within which said sensor signals are multiplied by associated weighting factors and combined to provide a network to output signal, (c) providing said control signal to said fuel injector as a function of said network output signal, (d) detecting an error in operation at the engine as a function of said sensor signals, and (e) altering said weighting factors by a predetermined increment upon each cycle of operation of said controller in a direction to reduce said error.

22. A method of controlling fuel delivery to an engine that has at least one fuel injector responsive to electronic control signals for delivering fuel to the engine and a plurality of sensors for supplying sensor signals as a function of differing parameters of engine operation, said method comprising the steps of:

(a) providing a digital controller that operates in cycles at periodic intervals, (b) directing said sensor signals within said controller to a neural network within which said sensor signals are multiplied by associated weighting factors and combined to provide a network to output signal, said sensor signals directed to said neural network including current sensor signals and sensor signals from a predetermined number of previous operating cycles of said controller, and (c) providing said control signal to said fuel injector as a function of said network output signal.

23. A method of controlling fuel delivery to an engine that has at least one fuel injector responsive to electronic control signals for delivering fuel to the engine and a plurality of sensors for supplying sensor signals as a function of differing parameters of engine operation, said method comprising the steps of:

(a) providing a digital controller that operates in cycles at periodic intervals, (b) directing said sensor signals within said controller to a neural network within which said sensor signals are multiplied by associated weighting factors and combined to provide a network to output signal, said neural network comprising multiple neural layers with input weighting factors and weighting factors between layers, (c) providing said control signal to said fuel injector as a function of said network output signal, (d) detecting an error in operation at the engine as a function of said sensor signals, and (e) altering said input weighting factors, while weighting factors between said layers remains constant, during each cycle of operation of said controller in a direction to reduce said error.

24. The method set forth in claim 20, 21, 22 or 23 comprising the additional steps of:

(f) directing said sensor signals within said controller to a feed-forward control unit responsive to said sensor signals for supplying a basic control signal, and (g) providing said control signal to said fuel injector as a combined function of said basic control signal and said network output signal.

25. The method set forth in claim 24 wherein said feed-forward control unit includes an electronic memory storing engine control parameters in at least one look-up table, and means for periodically addressing said memory as a function of said sensor signals to provide said basic control signal.

* * * * *